United States Patent [19]

Saito

[11] 4,095,368

[45] Jun. 20, 1978

[54] TOY PRIME MOVER AND ACCESSORIES THEREFOR

[76] Inventor: Shigeru Saito, No. 6-4, 2-chome, Kuramae, Taito-ku, Tokyo, Japan

[21] Appl. No.: 691,557

[22] Filed: May 25, 1976

Related U.S. Application Data

[63] Continuation-in-part of Ser. No. 608,539, Aug. 28, 1975, Pat. No. 3,961,440.

[51] Int. Cl.[2] ..... A63H 11/00; A63H 33/26

[52] U.S. Cl. ..... 46/104; 46/120; 46/143; 46/239; 46/266

[58] Field of Search ..... 46/103, 104, 264, 265, 46/266, 99, 119, 110, 206, 120, 142; 185/DIG. 1, 37, 39

[56] References Cited

U.S. PATENT DOCUMENTS

| | | | |
|---|---|---|---|
| 1,552,314 | 9/1925 | Kohl | 46/142 X |
| 1,765,238 | 6/1930 | McKaie | 46/142 |
| 2,600,340 | 6/1952 | Strauss | 46/104 |
| 3,128,575 | 4/1964 | Stanetzki | 46/120 |
| 3,728,815 | 4/1973 | Tomiyama | 46/104 |

*Primary Examiner*—F. Barry Shay
*Attorney, Agent, or Firm*—Michael J. Striker

[57] ABSTRACT

A toy prime mover has a hollow housing provided with a spring windup mechanism which can be wound up by a crank at the back of the housing and which has output shafts at the front of the housing, at the sides of the housing and at the bottom of the housing. Ground-engaging drive wheels are connected to the output at the bottom of the housing. A support plate can be connected to each of the shoulder joints surrounding each of the output members at the sides of the housing and each such support plate can carry a pair of large-diameter ground-engaging wheels that are driven via gears from the output member of the shoulder in order to allow the prime mover to displace itself over relatively rough terrain. A trailer may be connected to the back of the prime mover and has a ground-engaging steering wheel mounted on an arm carrying at its end a magnet. A wand also provided with a magnet can magnetically swing this arm to steer the prime mover without touching it. The output member at the front of the housing may be connected via a coil spring to the similar output member at the front of another such prime mover and the shoulder joints may be provided with ground-engaging support arms so that the two devices can be wound up and allowed to wrestle with each other.

15 Claims, 24 Drawing Figures

TOY PRIME MOVER AND ACCESSORIES THEREFOR

CROSS-REFERENCE TO RELATED APPLICATION:

This is a continuation-in-part of my copending application Ser. No. 608,539 filed Aug. 28, 1975 (now U.S. Pat. No. 3,961,440).

BACKGROUND OF THE INVENTION

The present invention relates to a windup toy. More particularly this invention concerns a toy prime mover and accessories mountable thereon to allow the prime mover to be used in various manners.

Various children's toys are known which have their own spring windup motors or electric motors that drive various parts of the toy. For example windup dolls are known which are capable of dancing, waving their arms, walking and the like. Furthermore toys are known wherein the internal motor drives wheels that engage the ground, crane-lifting mechanisms, throwing devices and the like. Such toys not only amuse the children using them, but fulfill the useful function of teaching them dexterity, and the basics of using machinery.

A problem with such devices is that very frequently the child tires of the relatively limited activity offered by one particular toy after a short time. Thus the newly acquired windup toy is soon discarded by the bored owner. Another problem with such toys is that they rarely teach the youngster the basics of machinery, as the interconnection of the various parts and functioning of the drive unit is altogether hidden within the device.

SUMMARY OF THE INVENTION

It is therefore an object of the present invention to provide an improved self-powered toy.

Another object is the provision of an improved toy prime mover of the windup type which can be used in various different manners so as to make the toy one of continuing interest and use.

Yet another object is to provide such a toy which will teach the child using it basic mechanical ideas.

Yet another object is to advance principles set forth in my above-identified copending patent application.

These objects are attained according to the present invention in a toy prime mover having a hollow housing provided internally with a spring windup mechanism having rotary output members at the sides, front and bottom of the housing and a rotatable input member for storing up energy applied to the input member and releasing such energy to the output members. A pair of ground-engaging drive wheels are provided at the bottom of the housing connected to the respective output member. In addition a shoulder mount is provided at the upper region of each of the sides of the housing and surround a respective output member. A chest mount is provided at the upper region of the front of the housing and surrounds a respective output member. Thus accessories can be attached to the mounts and driven by the respective output members for use of the prime mover in many applications.

In accordance with this invention the input member is at the back of the housing and is provided with a crank for winding up the mechanism. Furthermore the mechanism includes a pair of drums one of which is carried by the input member, a spring having ends each attached to a respective one of the drums, and gearing between the drums and the output members. In addition a detent is provided for preventing rotation of the output members until actuated so that the mechanism can be wound up and the output members will only start to rotate when the detent is operated.

Such a prime mover has the basic function of moving along the ground via its ground-engaging drive wheel. Non-usable arms can be mounted on the shoulder mounts and a dummy head can be mounted on the top of the housing to give it a robot appearance. In addition it is possible to secure various accessories to the drive members at the shoulder mounts and the chest mount in order to perform any of various tasks. For instance large wheels can be secured to the shoulder mounts in order to suspend the entire prime mover by its shoulder mount and displace it along the floor only by these wheels carried on the shoulder mounts.

It is also possible in accordance with this invention to mount rocket-launching type accessories on the arms which are automatically operated to fire springloaded missiles. A shovel scoop can be provided on one of the arms if desired as well as any of a multitude of accessories. Furthermore it is possible to secure the entire prime mover in a crane superstructure that connects to the chest mount so that this prime mover effectively acts as the drive and operator of a toy crane.

In accordance with further features of this invention an accessory is provided on the toy prime mover which comprises respective support plates having upper portions secured to respective shoulder mounts and lower portions on which are journalled front and rear wheels each carrying a respective rotationally fixed wheel gear. Means meshing with the wheel gears and including a main drive gear carried on the plate and connectable to the output member at the respective shoulder is provided for joint rotation of the front and rear wheels by the respective output member. These wheels are so positioned so that they lie below the drive wheels of the prime mover and, therefore, lift it up and allow it to move over terrain substantially more rugged than that which it could move over with the drive wheels alone.

A further feature of the above-described lunar-module type of accessory is that the drive gear meshes with a secondary drive gear that is journalled in the plate and in turn meshes with both of the wheel gears. A holder plate pivoted on a second support plate parallel to the first support plate and flanking the various gears can be replaced with a gear of fewer or lesser teeth in order to increase or decrease the advance speed of the unit, as normally the output members rotate at a given speed.

According to yet another feature of this invention a so-called telepathic trailer is provided which is secured to a hitch at the lower region of the back of the housing of the prime mover and has an arm pivoted about an upright axis on the trailer and carrying a ground-engaging guide wheel. A magnetic body is carried on the arm offset from the pivot axis of the arm and a wand is provided which has at one end another magnetic body capable of magnetically attracting or repelling the body on the arm without touching this body and thereby swinging the arm about the axis. At least one of the bodies is a permanent magnet and the arm carries its magnetic body at one end, is pivoted at its opposite end, and carries the wheel at the pivot end, caster-fashion. The trailer has a wall over the arm and provided with a synthetic-resin window at the body on the arm so that the two magnetic bodies can act on each other. Such an arrangement allows the prime mover to be guided along the ground without touching it, merely by moving the wand over the telepathic trailer.

According to yet another feature of this invention a wrestler-duo accessory is provided usable with two of the prime movers as described above. Each of these prime movers carries on its chest mount coupled to the respective output member a support body. A coil spring extends between these support bodies and arms are secured to the shoulder mounts of both of the facing prime movers with their lower ends in engagement with the ground. When the detents of the spring windup mechanisms are released the output members at the chests of the two prime movers will rotate in opposite directions until the torque exerted by the coil spring between the two will overturn one of the prime movers. To this end the arms are not connected to their respective output members and have lower ends which lift the drive wheels of the robot off the ground. The use of a spring between the two members will create a relatively random effect so that at times one of the prime movers will overturn the other and at times the other will overturn the one.

With the toy according to the present invention a great many possibilities of amusement are provided for the child owner. In addition the coupling of the various accessories to the basic prime mover unit habituates him to various machine operations which are entirely similar to principles which will serve him well later in life. Furthermore the basic drive unit, which is the most expensive part of the toy, can be used in many different ways so that the overall cost of a complicated system of such toys is relatively low.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 8 is another main drive gear usable with this accessory;

DESCRIPTION OF THE PREFERRED EMBODIMENTS

Figure 1:
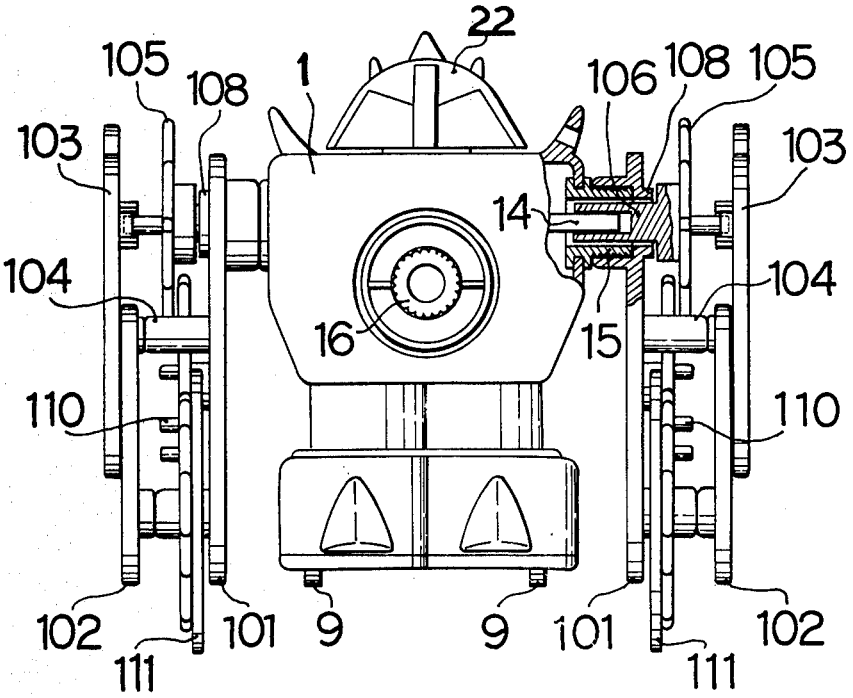
FIG. 1 is a front view partly in section of the prime mover according to this invention with the lunar-module accessory.

Reference is first made to FIGS. 21–24 which show the prime mover unit described in my above-cited copending patent application whose entire disclosure is incorporated herewith by reference.

A cubical box frame or housing 1 is made from plastic or synthetic-resin material and is equipped with a mechanism frame 2 inside it. A main shaft 3 passes through the mechanism frame 2 and is journalled at the front and rear of the frame 2. A drum 5 is attached to the front portion of the main shaft 3 outside the mechanism frame 2. Underneath and near the drum 5, a drum 6 is arranged to be mounted on a subsidiary shaft 7. A spring 4 has ends fixed to the circumferences of the drums 5 and 6 and is wound about the drum 5 from the drum 6 by revolving an input crank or handle 17 and rotation power is stored in the spring 4.

A rotatable output shaft 8 is mounted in both sides of the lower portion of the mechanism frame 2, and a pair of small wheels 9 are attached to both ends of the rotatable member 8. The lower halves of the wheels 9 project downwardly from a pair of slots 11 on a bottom plate 10 of the box frame 1. A square output shaft 12 is arranged to pass transversely through the upper portion of the mechanism frame 2 and a worm 13 is fixed to the middle portion of this square shaft 12. This worm 13 meshes with a worm gear of the main shaft 3 and is made to rotate thereby. Both ends 14 of the square shaft 12 are housed freely inside a pair of projecting tubular connectors or mounts 15 attached to both sides of the box frame 1. A main shaft connector or output 16 which is fixed to the front side of the drum 5 projects from the front of the box frame 1.

The rear or input end of the main shaft 3 projects from the back of the box frame 1 and is fitted with the handle 17. A tubular connector 18 stands up at the center on the top of the box frame 1 and a semicircular ring connector or hitch 19 is attached to the lower middle portion of the back of the box frame 1.

If the main shaft 3 is revolved by the handle 17, the spring 4 is wound about the drum 5 from the drum 6 and has energy that is used as it winds off the drum 5. This power is a motive power usable to work toys not having prime movers or auxiliary toy parts. Then, after winding up the spring 4, if a stopper 20 is disconnected from the transmission gear, the spring 4 is made to wind off from the drum 5 and wind about the drum 6, and simultaneously the main shaft 3, the square shaft 12 and the rotatable shaft or axle 8 are revolved.

Figure 10:
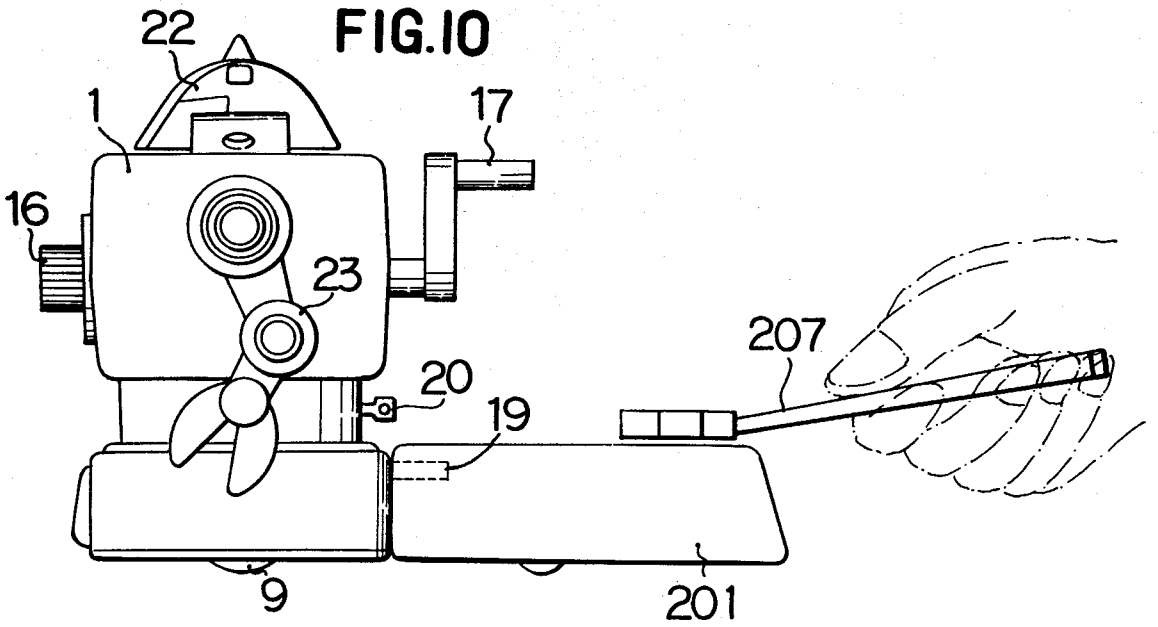
FIG. 10 is a side view of the prime mover unit with the telepathic-trailer accessory according to this invention.
Figure 11:
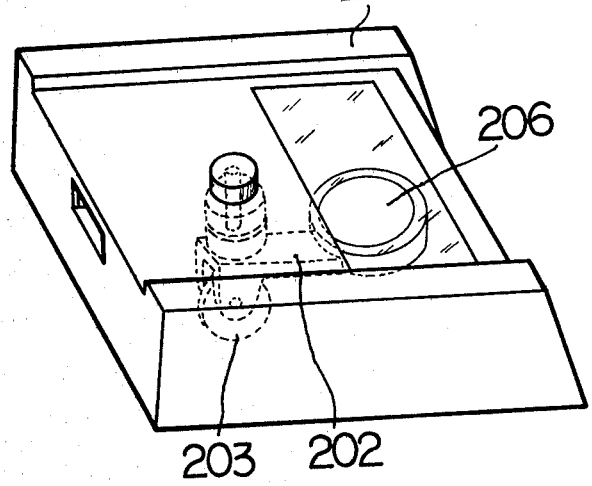
FIG. 11 is a perspective view of the trailer shown in FIG. 10.
Figure 12:
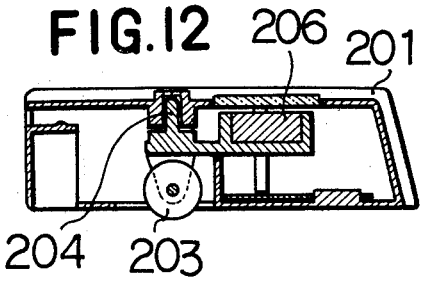
FIG. 12 is a vertical section through the trailer shown in FIG. 10.
Figure 13:
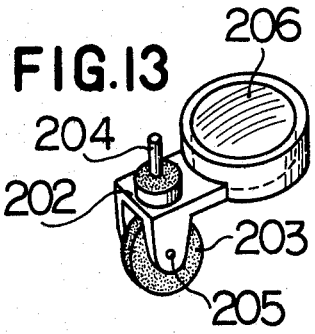
FIG. 13 is a perspective view of a detail of the trailer of FIG. 10.
Figure 14:
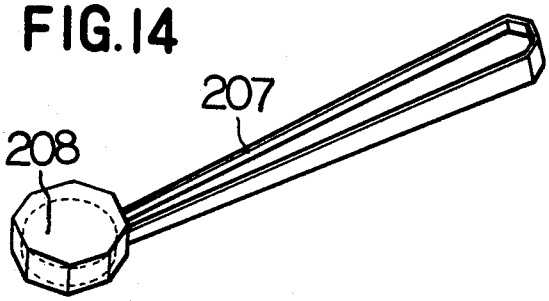
FIG. 14 is a perspective view of the wand usable with the trailer of FIG. 10.
Figure 15:
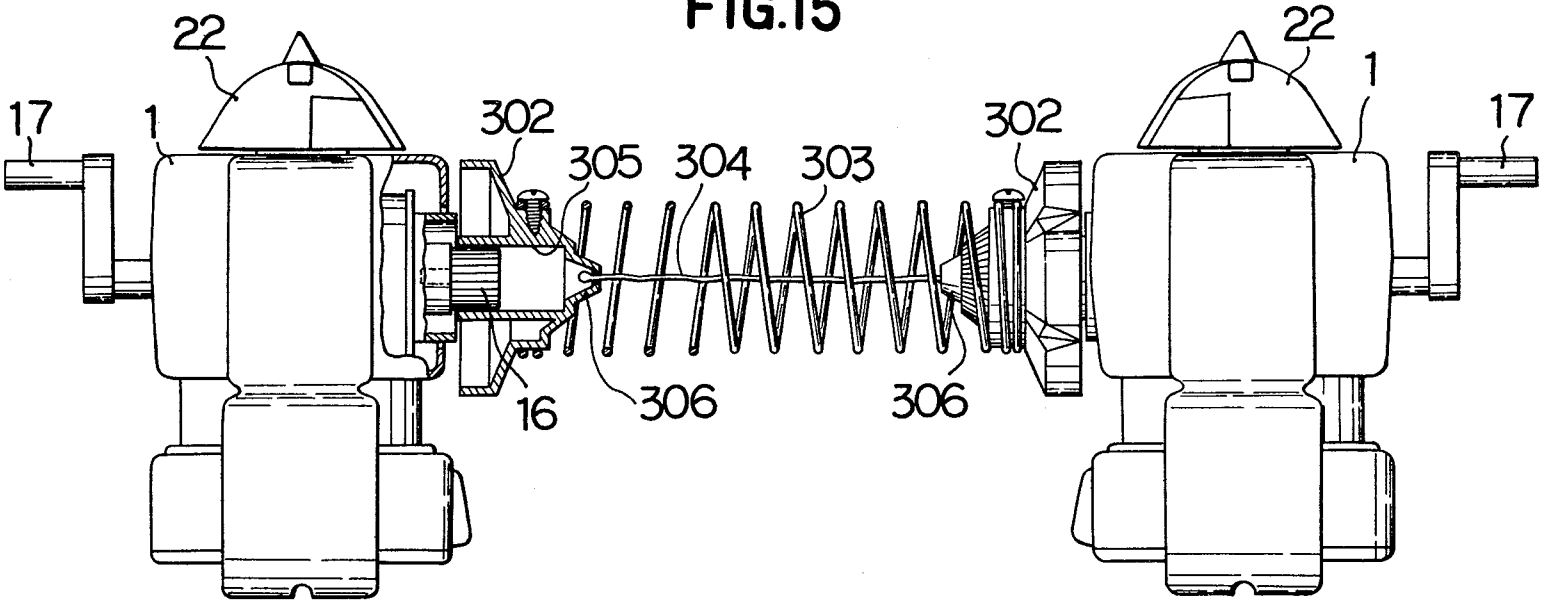
FIG. 15 is a side view partly in section of a pair of prime movers with the wrestler-duo accessory in accordance with this invention.
Figure 16:
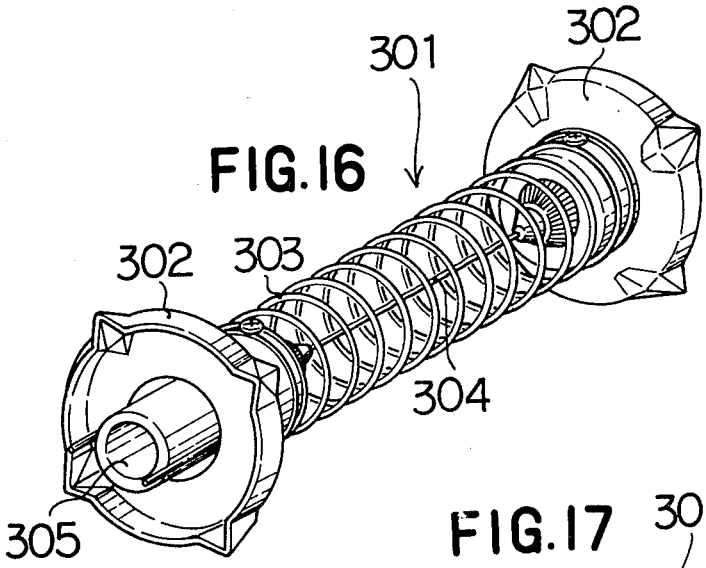
FIG. 16 is a perspective view of the accessory shown in FIG. 15.
Figure 17:
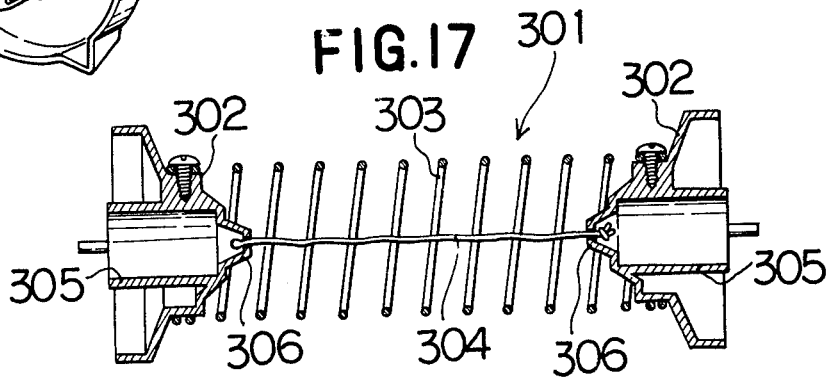
FIG. 17 is an axial section through the accessory of FIG. 15.
Figure 18:
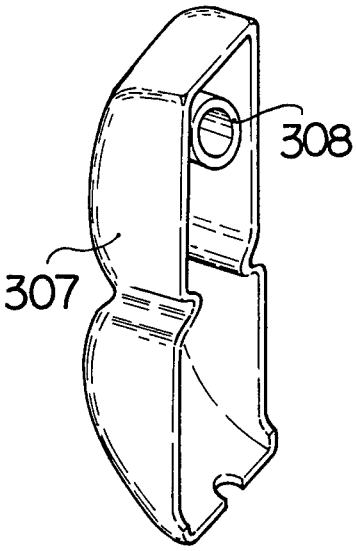
FIGS. 18 and 19 are perspective views from different angles of the support arm usable with the accessory of FIG. 15.
Figure 19:
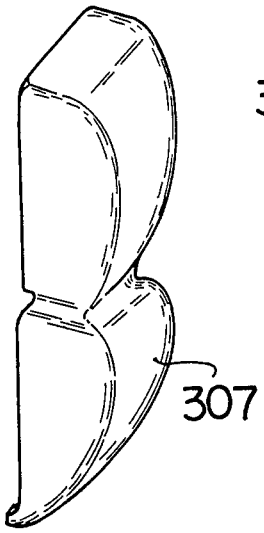
Figure 20:
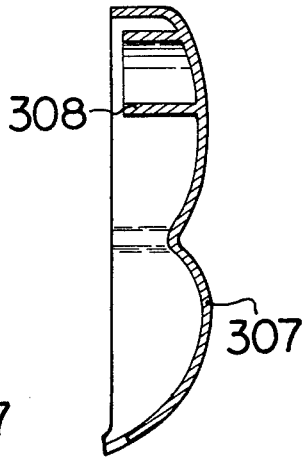
FIG. 20 is a longitudinal section through one of the support arms of FIG. 19.
Figure 21:
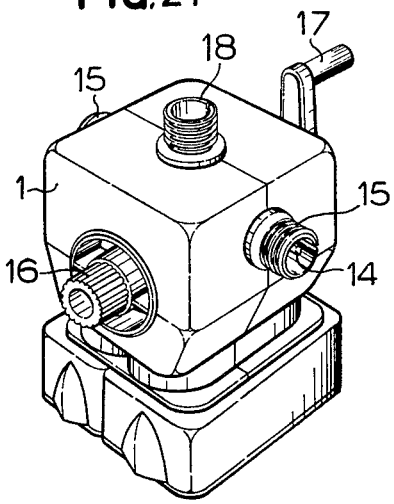
FIGS. 21 and 22 are front and rear perspective views of the basic prime mover unit in accordance with this invention.
Figure 22:
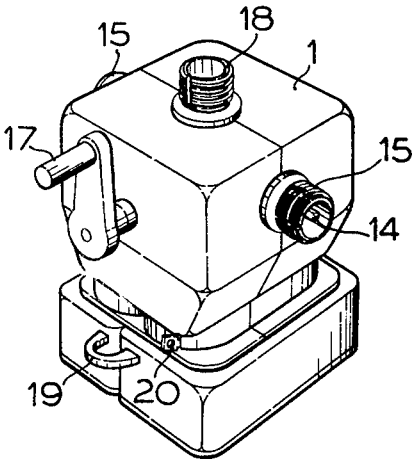
Figure 23:
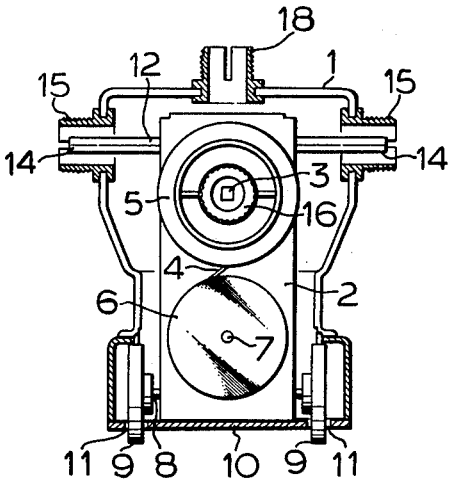
FIG. 23 is a vertical section through the prime mover in accordance with this invention.
Figure 24:
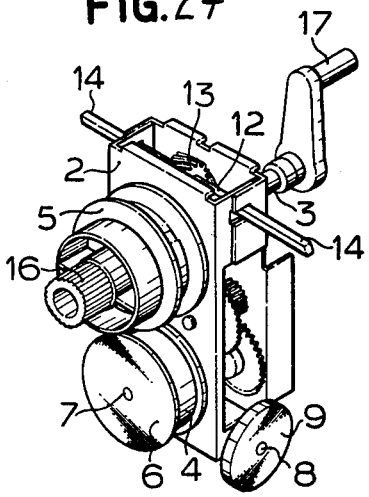
FIG. 24 is a perspective view of the windup mechanism of the prime mover unit.

As shown in FIGS. 1, 10 and 15 the spring prime mover unit may be disguised as a robot which wears a cap 22 on the tubular connector 18 at the top of the box frame 1 and two arms 23 to the tubular connectors 15 at both sides of the box frame 1.

FIGS. 1–9 show a lunar-vehicle module usable with the prime mover shown in FIGS. 21–24. Such a unit is employed to allow the prime mover to move over rougher ground than it could negotiate with the relatively small-diameter wheels 9.

Figure 2:
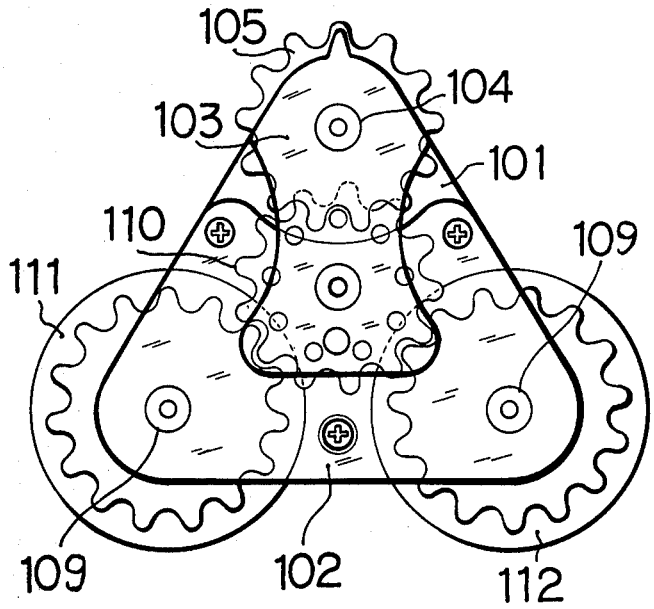
FIG. 2 is a side view of the accessory of FIG. 1.
Figure 3:
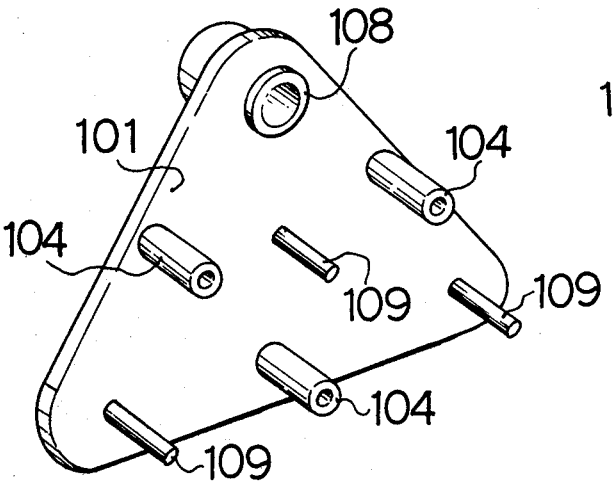
FIG. 3 is a perspective view of the main support plate of the accessory of FIG. 1.
Figure 6:
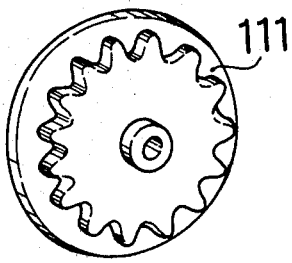
Figure 7:
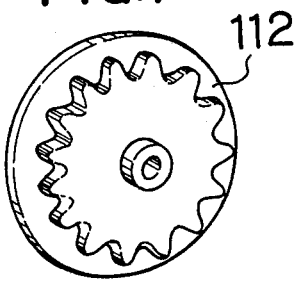
Figure 8:
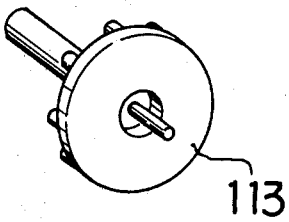
Figure 9:
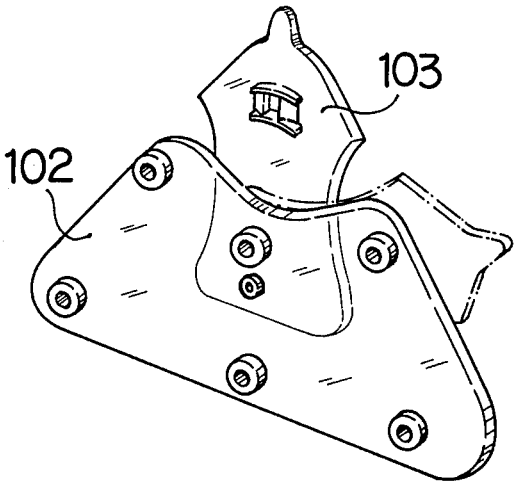
FIG. 9 is a perspective view of the secondary support plate and holder plate of the accessory of FIG. 1.

This accessory, which comprises two identical units as clearly indicated in FIG. 1, has a main support plate 101 adapted to be snugly fitted over the shoulder mount 15 and connected via spacers 104 forming a triangular array as shown in FIG. 3 from a secondary support plate 102 secured to these spacers 104 by screws shown in FIG. 2. Pins 109 extending between the synthetic-resin plates 101 and 102 at the front and rear corners of these triangular plates rotatably carry front and rear wheels 111 and 112 integrally formed as shown in FIGS. 6 and 7 with gears that mesh with the external teeth of a secondary drive gear 110 shown in FIG. 5 that itself is journalled on a pin 109 above and between the pins 109 carrying the wheels 111 and 112.

Figure 4:
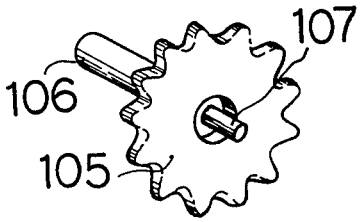
FIGS. 4, 5, 6, 7 and 8 are views of the main drive gear, the secondary drive gear, the front wheel and the rear wheel, respectively, of the accessory of FIG. 1.
Figure 5:
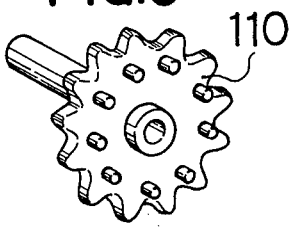

The secondary drive wheel 110 has an annular array of angularly equispaced axially extending pins that mesh with the teeth of a main drive gear 105 shown in FIG. 4. This gear 105 has at one side a pin 107 that is received in a recess in a pivotal support plate 103 and on its other side a sleeve 106 adapted to pass through the mounting sleeve 108 formed on the plate 101 and to engage rotationally with the square output member 14 at the respective shoulder joint 15. Pivoting of the support plate 103 to the side as shown in dot-dash lines in FIG. 9 allows the gear 105 to be removed and replaced with another gear such as the gear 113 shown in FIG. 8 so as to drive the arrangement at a different speed. It is noted that the connection between the mounting sleeve 108 and the shoulder joint 15 need not be extremely rigid, as the normal bottom-heavy module will tend to hang by its shoulders normally under any circumstances.

FIGS. 10–14 show a so-called telepathic trailer arrangement. This unit comprises a hollow body 201 which is normally coupled to the hitch 19 and which normally lies against the flat back of the housing 1 so as to be non-pivotal on this hitch 19. Inside this body there is provided a ground-engaging wheel 203 pivotal about a horizontal axis 205 perpendicular to the axis of an upright pivot shaft 204 that is journalled in the top wall of the housing 201. The arm 202 carrying these two axles 205 and 204 carries at its rear end a large permanent magnet 206 which lies under a lucite window in the housing 201 and can coact with another permanent magnet 208 carried on the front end of an elongated wand 207.

This caster 203 therefore can have its angular position determined by the wand 207 without any physical contact being made between this wand 207 and the structure being guided. Thus the user need merely swing the wand 207 across the back of the trailer 201 toward the right to cause the assembly being displaced along the ground via the drive wheels 9 to move toward the right. Since the axes of the shafts 204 and 205 intersect, once set in a new position there is no force exerted on the arm tending to swing it back into a central neutral position.

The arrangement of FIGS. 15–20 allows two modules described with reference to FIGS. 21–24 to effectively wrestle with each other. To this end each of the modules is fitted at shoulder joints 15 with arms 307 shown in FIGS. 18–20 which have sleeves 308 adapted to engage snugly over the shoulder joints 15 so as to support the housings 1 with their wheels 9 clear of the ground as shown in FIG. 15. Thus the prime movers will not move toward or away from one another. Mounted on each of the front joints 16 is a respective shield-like and generally frustoconical support body 302 formed with an internal hole 305 that tightly engages over this chest joint 16. Thus the force of the spring 4 will be effective only at the joint 16 so as to rotate the body 302. Each end of a coil spring 303 is secured to one such body 302 and a string 304 passes between the tips 306 thereof to limit the maximum extension of this spring 303.

The above-described structure constitutes a wrestling assembly 301 which, when mounted between two modules as shown in FIG. 15 will cause each module to try to turn the spring 303 in one direction. Since the modules are identical and face one another their rotation directions will be opposite so that the spring 303 will be tensioned until one of the modules overturns the other. Due to the relatively great length of the spring 303 and the fact that the modules will tend to shift somewhat during such "wrestling" the one module will win sometimes and the other module will win at other times.

Thus the toy according to the present invention can be used in many ways. The various accessories described in this application and in the parent application can all be produced at very low cost and allow a relatively simple basic structure to be used in any of a multitude of ways for maximum enjoyment and educational value by the child-owner.

It will be understood that each of the elements described above, or two or more together, may also find a useful application in other types of structures differing from the types described above.

While the invention has been illustrated and described as embodied in a toy, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A toy prime mover comprising a hollow housing having opposite sides, a front, a back, and a bottom; means including a spring windup mechanism mounted in said housing having rotary output members at said sides, said front, and said bottom and a rotatable input member for storing up energy applied to said input member and releasing such energy to said output members; a pair of ground-engaging drive wheels at said bottom connected to the respective output member; means secured to said mover, accessible from the exterior of said housing, whereby accessories can be attached to the mover and driven by the respective output member, said means including a shoulder mount at the upper region of each of said sides surrounding the respective output member and a chest mount at the upper region of said front at the respective output member.

2. The toy prime mover defined in claim 1, wherein said input member is at said back and is provided with a crank for winding up said mechanism.

3. The toy prime mover defined in claim 2, wherein said mechanism includes a pair of drums one of which is carried on said input member, a spring having ends each attached to a respective one of said drums, and gearing between said drums and said output members.

4. The toy prime mover defined in claim 1, further comprising, at lock side of said mover, a support plate having an upper portion securable to one of said shoulder mounts and a lower portion lying adjacent said bottom; a front wheel journalled on said plate at said lower portion toward said front; a rear wheel journalled on said plate at said lower portion toward said back; a wheel gear carried on and rotationally fixed to each of said wheels carried on said plate; and means meshing with said wheel gears and including a main drive gear carried on said upper region of said plate and connectable to the output member at the respective shoulder mount for joint rotation of said main drive gear and the respective output member for rotation of said front and rear wheels by the respective output member.

5. The toy prime mover defined in claim 4, wherein said means meshing includes a secondary drive gear journalled on said plate and meshing with said main drive gear and both of said wheel gears.

6. The toy prime mover defined in claim 5, further comprising, on each said side, a second support plate parallel to and secured to the first-mentioned support plate, said plates flanking said secondary drive gears and the upper regions of said wheels.

7. The toy prime mover defined in claim 6, further comprising a displaceable holder plate on said second support plate, said main drive gear being held in place by said holder plate, whereby said holder plate can be moved aside for replacement of said main drive gear.

8. The toy prime mover defined in claim 6, wherein said secondary drive gear is formed with peripheral teeth meshing with said wheel gears and with an annular array of angularly equispaced pins meshing with said main drive gear.

9. The toy prime mover defined in claim 1, further comprising a hitch at the lower region of said back; a trailer securable to said hitch; an arm pivoted on said trailer about an upright axis; a ground-engaging guide wheel carried on said arm at said axis, whereby the angular position of said arm determines the direction said prime mover will follow when driven by said drive wheels; a magnetic body carried on said arm offset from said axis; and a wand having at one end another magnetic body capable of magnetically displacing the body on said arm without touching said body and thereby swinging said arm about said axis.

10. The toy prime mover defined in claim 9, wherein at least one of said bodies is a permanent magnet.

11. The toy prime mover defined in claim 10, wherein said arm carries its body at one end and is pivoted at its opposite end.

12. The toy prime mover defined in claim 11, wherein said trailer has a wall over said arm and provided with a synthetic-resin window at said body on said arm.

13. The toy prime mover defined in claim 1, further comprising respective arms securable to the shoulder mounts of a pair of facing prime movers and having ground-engaging lower ends; a coil spring having a pair of ends; a support body secured to each of said coil spring ends for rotation therewith and in turn mountable on a respective chest mount of a respective one of said pair of movers in driving engagement with the respective output member, whereby the rotary movements of said output members at said chest mounts of said facing movers are transmitted to each other through said spring until one of said movers is turned over.

14. The toy prime mover defined in claim 13, further comprising a nonextensible flexible element having one end connected to one of said support bodies and an opposite end secured to the other support body, whereby the maximum spacing between said bodies is determined by the length of said element.

15. The toy prime mover defined in claim 13, wherein each of said arms is out of contact with the respective output member at the respective shoulder mount and is of such a length that the respective prime mover is held above the ground by said arms with said drive wheels above the ground.

* * * * *